US011696605B2

(12) United States Patent
Li

(10) Patent No.: US 11,696,605 B2
(45) Date of Patent: Jul. 11, 2023

(54) CORSET

(71) Applicant: Guangdong Rebitch Product Design Co., Ltd., Guangdong (CN)

(72) Inventor: Sinuo Li, Guangdong (CN)

(73) Assignee: Guangdong Rebitch Product Design Co., Ltd., Shenzhen (CN)

( * ) Notice: Subject to any disclaimer, the term of this patent is extended or adjusted under 35 U.S.C. 154(b) by 116 days.

(21) Appl. No.: 17/240,952

(22) Filed: Apr. 26, 2021

(65) Prior Publication Data

US 2022/0330625 A1 Oct. 20, 2022

(30) Foreign Application Priority Data

Apr. 14, 2021 (CN) ..... 202120758178.8

(51) Int. Cl.
*A41C 1/06* (2006.01)
*A41C 1/16* (2006.01)

(52) U.S. Cl.
CPC . *A41C 1/06* (2013.01); *A41C 1/16* (2013.01)

(58) Field of Classification Search
CPC ..... A41C 1/06; A41C 1/16; A41C 1/02
See application file for complete search history.

(56) References Cited

U.S. PATENT DOCUMENTS 2,031,022 A * 2/1936 Wipperman ..... A41C 1/06 450/27
2,387,552 A * 10/1945 Alberts ..... A41C 1/06 260/665 R
2,388,525 A * 11/1945 Cohen ..... A41C 1/06 450/131
2,593,832 A * 4/1952 Barcley ..... A41C 1/06 450/24
2006/0276103 A1* 12/2006 Teng ..... A41C 1/06 450/10
2015/0245670 A1* 9/2015 Angelino ..... A41C 3/06 450/143

* cited by examiner

*Primary Examiner* — Gloria M Hale

(57) ABSTRACT

A corset includes: a left-front portion, a right-front portion, a back portion, a left accessory breast receiving portion, and a right accessory breast receiving portion. A left side of the back portion is connected to a right side of the left-front portion, and a right side of the back portion is connected to a left side of the right-front portion. The left-front portion is provided at a left side thereof with multiple rows of loops, and the right-front portion is provided at a right side thereof with hooks, the hooks and the multiple rows of loops being connected to each other by hooking. The left accessory breast receiving portion, the right accessory breast receiving portion, and the back portion form a U-shaped back neckline, and the left accessory breast receiving portion, the right accessory breast receiving portion, the left-front portion, and the right-front portion form a U-shaped front neckline.

6 Claims, 5 Drawing Sheets

CORSET

CROSS REFERENCE TO RELATED APPLICATIONS

The present application claims the benefit of Chinese Patent Application No. 202120758178.8 filed on Apr. 14, 2021, the contents of which are incorporated herein by reference in their entirety.

FIELD OF THE INVENTION

The present disclosure relates to a body shaper, and in particular, to a corset.

BACKGROUND OF THE INVENTION

With the advancement of society and improvements of economic incomes and living standards, more and more people start to pay attention to management of their own body shape. It is a nature of a female to pursue beauty, and currently more and more females start to use methods such as body shaper, surgery, and exercise to achieve a better body shape. At present, popular ways of body shaping include: body shaper, Pilates, yoga, liposuction, fitness exercise, and the like, and most females hope that they have a body shape as perfect as possible. Accordingly, losing weight and body shaping are first choices of most females currently. Wearing a body shaper is the most convenient and easiest one among these body-shaping methods, and thus is accepted and favored by most females. Among all body shapers, the corset containing rubber as a component has the best effect. More and more females tend to use an elastic body-shaping corset. However, body-shaping corsets currently available in the market have limitations in their materials, and therefore when one wears a body-shaping corset, a lot of fat still gathers around the waist, and the curve at the waist is not smooth. When one wears and uses a body-shaping corset currently available in the market, since an upper portion of the body-shaping corset provides an overly strong tightening force, there is a great difference between fat density at the back and an underarm position and fat density at a position where the body-shaping corset is used, so that fat gathering at the back and the underarm position is caused. Seen from the aesthetic aspect, this results in a less perfect body shape instead for a female. This is especially true when a female wears a body shaper but has bumps of fat on the body. Seen from the health aspect, fat gathering affects lymphatic circulation, results in accumulation of toxins, leads to formation of acquired accessory breasts, thereby influencing the health. Therefore, it is desirable to provide a corset which has a better body-shaping effect, is comfortable to wear, does not block lymph, and makes up an imperfection in the body shape of a female.

SUMMARY OF THE INVENTION

In order to solve the above problems, the present disclosure provides a corset.

The corset includes: a left-front portion, a right-front portion, a back portion, a left accessory breast receiving portion, and a right accessory breast receiving portion. A left side of the back portion is connected to a right side of the left-front portion, and a right side of the back portion is connected to a left side of the right-front portion. The left-front portion is provided at a left side thereof with multiple rows of loops, and the right-front portion is provided at a right side thereof with hooks, the hooks and the multiple rows of loops being connected to each other by hooking. A lower end of the left accessory breast receiving portion is connected to an upper end of the left-front portion and an upper end of the back portion sequentially, and a lower end of the right accessory breast receiving portion is connected to an upper end of the right-front portion and an upper end of the back portion sequentially. The left accessory breast receiving portion, the right accessory breast receiving portion, and the back portion form a U-shaped back neckline, and the left accessory breast receiving portion, the right accessory breast receiving portion, the left-front portion, and the right-front portion form a U-shaped front neckline.

Further, the corset includes an edge covering, which is connected by seaming to outer edges of the left-front portion, the left accessory breast receiving portion, the back portion, the right accessory breast receiving portion, and the right-front portion.

Further, the corset further includes multiple supporting steel ribs, which are disposed along a longitudinal direction of the corset.

Further, an upper end of the left accessory breast receiving portion and an upper end of the right accessory breast receiving portion each have a curved shape.

Further, the corset is provided therein with a plurality of air-permeable through holes for air permeation.

Further, the left-front portion, the back portion, the right-front portion, the left accessory breast receiving portion, and the right accessory breast receiving portion are formed integrally.

The corset provided in the present disclosure has the following beneficial technical effects.

The corset in the present disclosure has a simple structural design, is convenient to wear, and has good air permeability. The corset has accessory breast receiving and body shaping functions, and thus can meet a need of upper body shaping of females.

BRIEF DESCRIPTION OF THE DRAWINGS

In order to better describe embodiments of the present disclosure or technical solutions in existing technologies, drawings required in describing the embodiments and the existing technologies will be described briefly below. Obviously, drawings described below are only drawings of some embodiments of the present disclosure, and those of ordinary skill in the art can also obtain other drawings based on these drawings without making any creative effort.

DETAILED DESCRIPTION OF THE EMBODIMENTS

Figure 1:
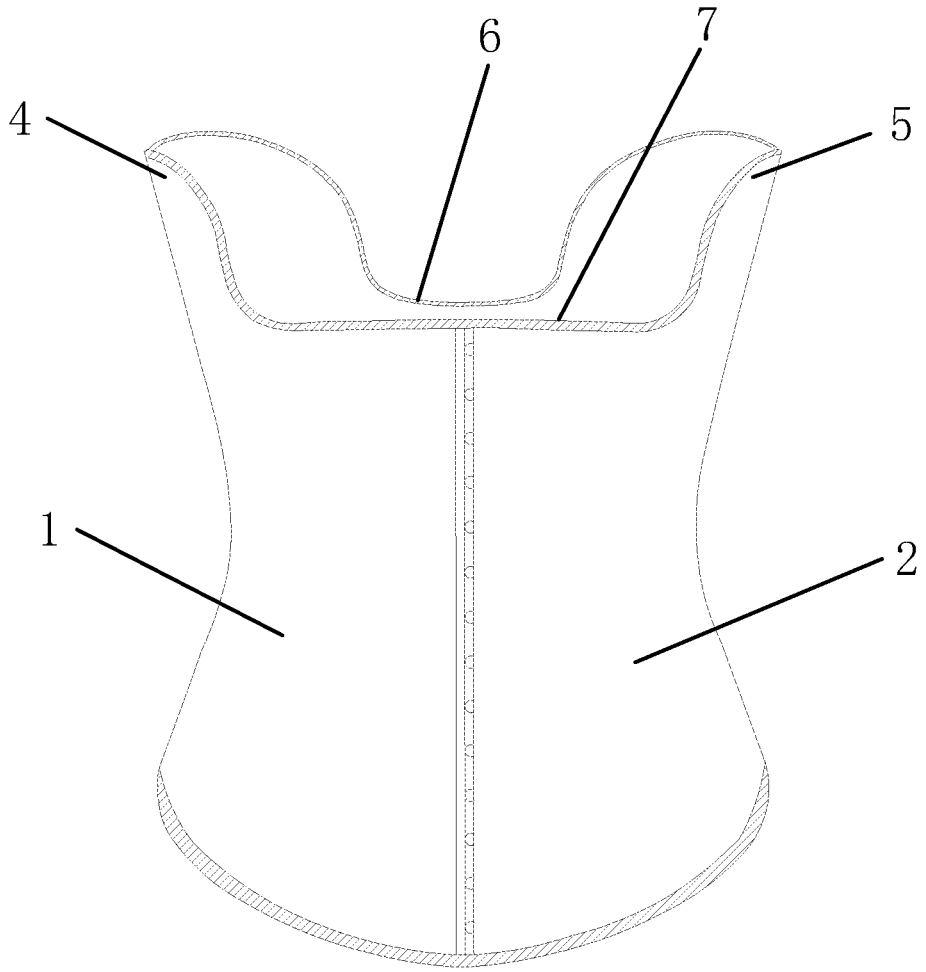
FIG. 1 is a first schematic diagram of a structure of a corset in the present disclosure.
Figure 2:
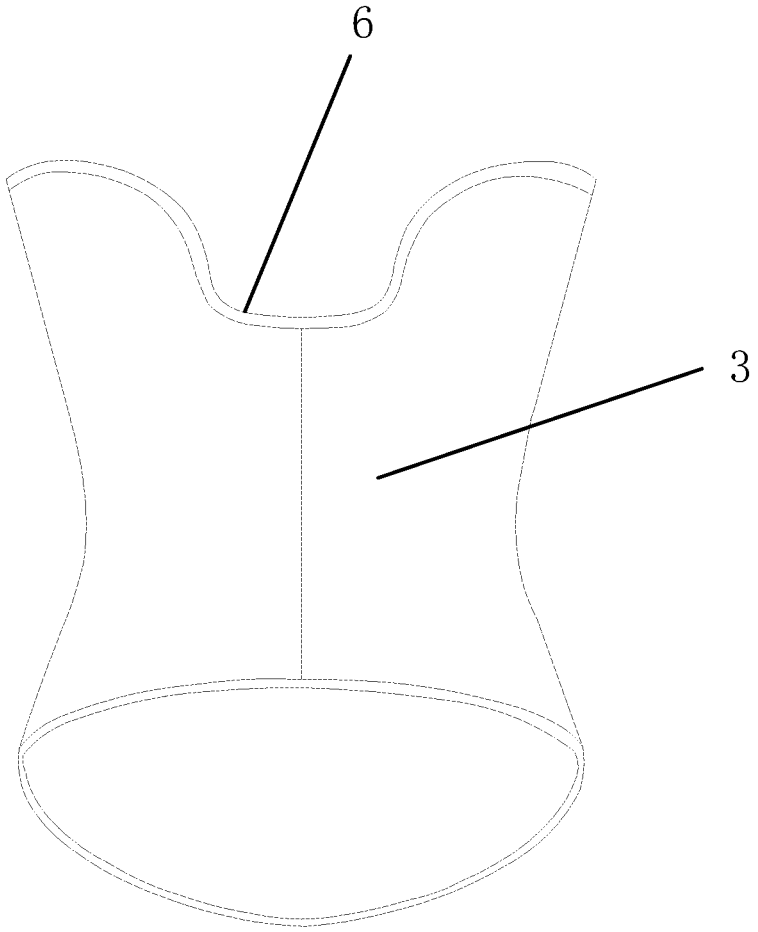
FIG. 2 is a second schematic diagram of the structure of the corset in the present disclosure.
Figure 3:
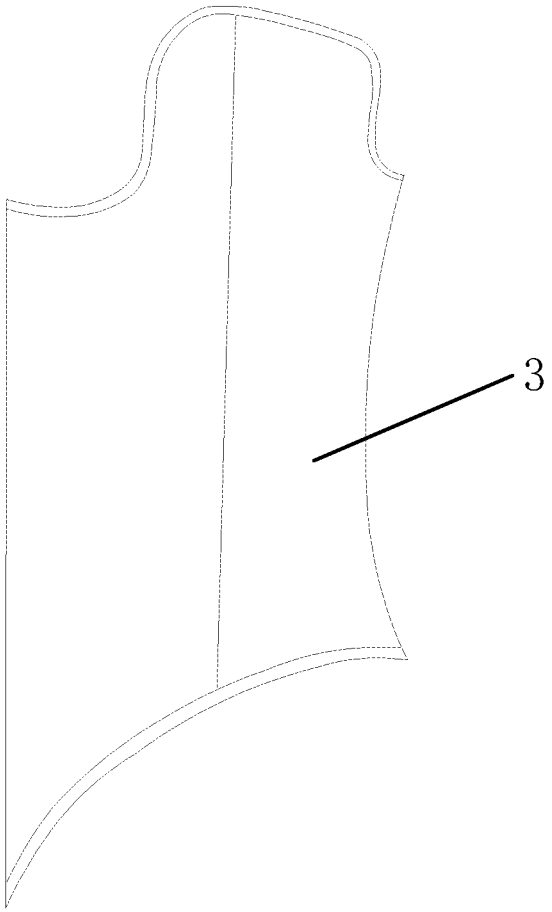
FIG. 3 is a third schematic diagram of the structure of the corset in the present disclosure.
Figure 4:
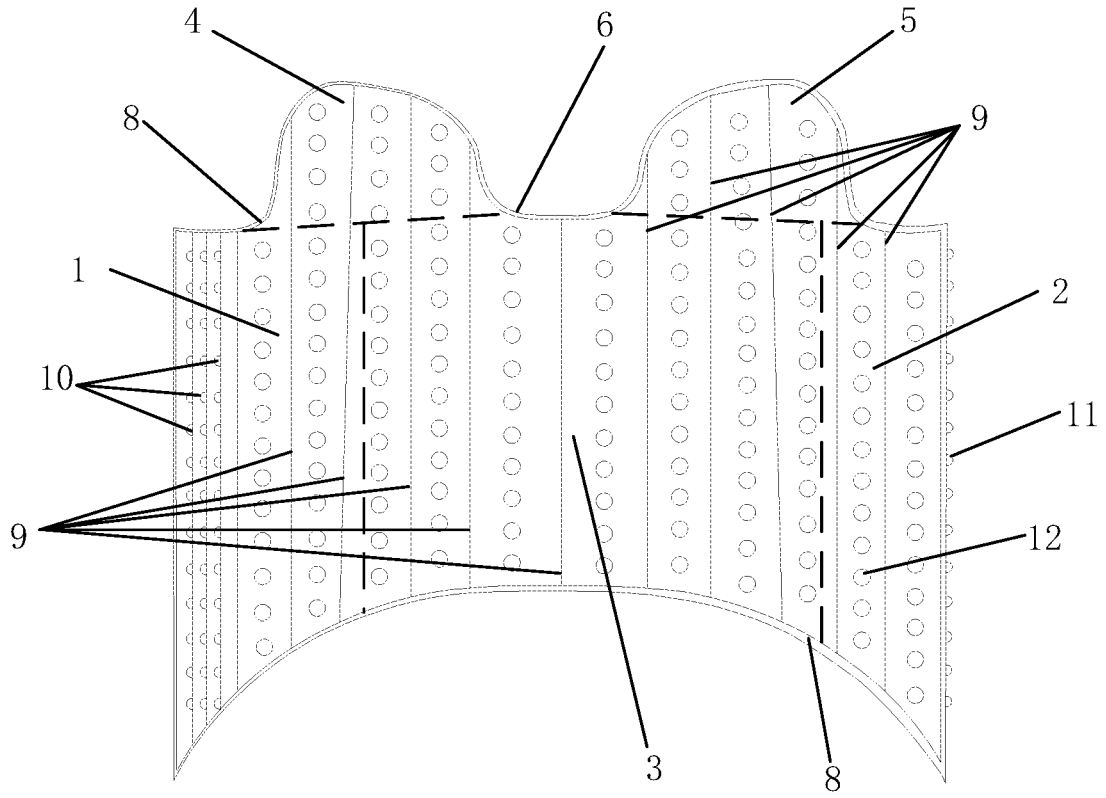
FIG. 4 is a schematic diagram of the corset in the present disclosure in an unfolded state.

Technical solutions in embodiments of the present disclosure will be described clearly and completely with reference to the accompanying drawings in the embodiments.

Obviously, the embodiments described are only some embodiments, rather than all embodiments, of the present disclosure. All other embodiments obtained by those of ordinary skill in the art based on the embodiments of the present disclosure without making any creative effort fall into the protection scope of the present disclosure.

Referring to FIGS. 1 to 4, a corset in embodiments of the present disclosure includes a left-front portion 1, a right-front portion 2, a back portion 3, a left accessory breast receiving portion 4, and a right accessory breast receiving portion 5. A left side of the back portion 3 is connected to a right side of the left-front portion 1, and a right side of the back portion 3 is connected to a left side of the right-front portion 2. The left-front portion 1 is provided at a left side thereof with multiple rows of loops 10, and the right-front portion 2 is provided at a right side thereof with hooks 11. The hooks 11 and the multiple rows of loops 10 are connected by hooking, and the multiple rows of loops 10 and the hooks 11 are detachably connected as required to adjust tension of the corset. A lower end of the left accessory breast receiving portion 4 is connected to an upper end of the left-front portion 1 and an upper end of the back portion 3 sequentially, and a lower end of the right accessory breast receiving portion 5 is connected to an upper end of the right-front portion 2 and an upper end of the back portion 3 sequentially. The left accessory breast receiving portion 4, the right accessory breast receiving portion 5, and the back portion 3 are connected and form a U-shaped back neckline 6, and the left accessory breast receiving portion 4, the right accessory breast receiving portion 5, the left-front portion 1, and the right-front portion 2 are connected and form a U-shaped front neckline.

The corset includes an edge covering 8, which is connected by seaming to outer edges of the left-front portion 1, the left accessory breast receiving portion 4, the back portion 3, the right accessory breast receiving portion 5, and the right-front portion 2.

The corset further includes multiple supporting steel ribs 9, which are disposed along a longitudinal direction of the corset.

An upper end of the left accessory breast receiving portion 4 and an upper end of the right accessory breast receiving portion 5 each has a curved shape.

The corset is provided therein with a plurality of air-permeable through holes 12 for air permeation, which are formed by a laser matrix and is used for reducing a muggy feeling during wearing of the corset.

The left-front portion 1, the back portion 3, the right-front portion 2, the left accessory breast receiving portion 4, and the right accessory breast receiving portion 5 are formed integrally, which can greatly reduce the production cost.

The present disclosure is further described below.

Figure 5:
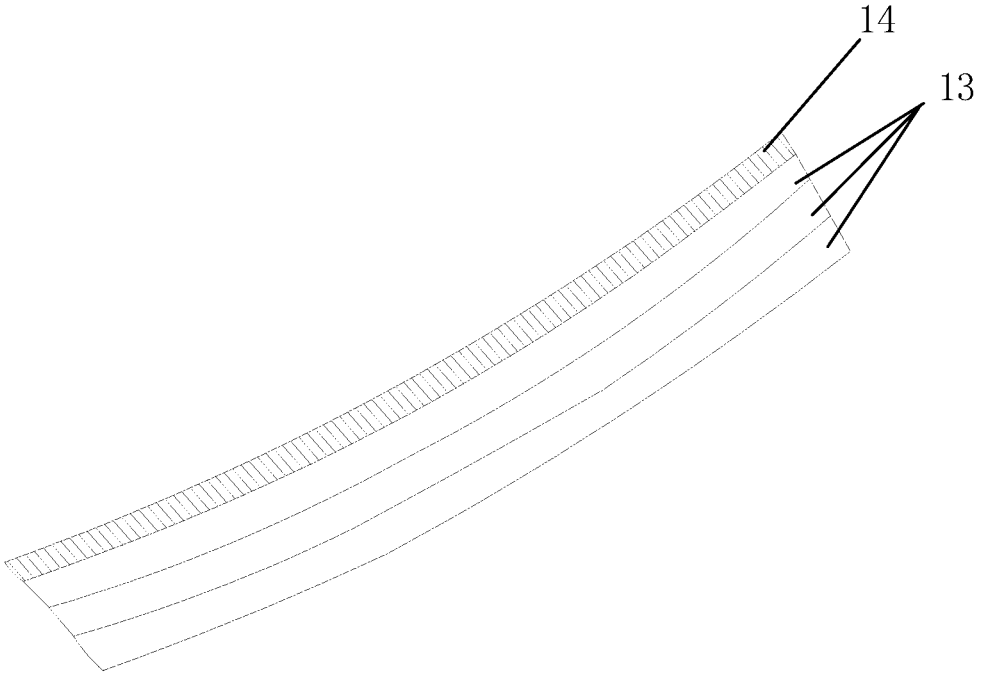
FIG. 5 is a schematic diagram of a multi-layer fabric structure and a skin-contacting layer of each portion of the corset in the present disclosure.

The corset in the present disclosure has an overall structure with a curved and narrowed middle section and gradually increasing upper and lower openings. The left-front portion 1, the right-front portion 2, the back portion 3, the left accessory breast receiving portion 4, and the right accessory breast receiving portion 5 each have a multi-layer fabric structure 13 and a skin-contacting layer 14, as shown in FIG. 5. Each layer of fabric 13 is formed from raw materials of the following parts by weight: 24-57 parts of rubber, 21-32 parts of bamboo fiber, 3.7-7 parts of graphene powder, 3.7-7 parts of tourmaline powder, 12-18.6 parts of modal fiber, and 18-30 parts of cotton. The skin-contacting layer 14 is made of an anti-bacterial fabric, which can effectively reduce bacteria breeding.

The corset provided in the present disclosure has the following beneficial technical effects.

The corset in the present disclosure has a simple structural design, is convenient to wear, has good air permeability, and has low production cost. The corset has accessory breast receiving and body shaping functions, and thus can meet a need of upper body shaping of females.

The above described embodiments are merely preferred embodiments of the present disclosure and are not intended for limiting the present disclosure. Modifications, equivalent substitutions, and improvements made within the spirit and principles of the present disclosure shall all fall within the protection scope of the present disclosure.

The invention claimed is:

1. A corset, comprising: a left-front portion, a right-front portion, a back portion, a left accessory breast receiving portion, and a right accessory breast receiving portion, wherein a left side of the back portion is connected to a right side of the left-front portion, and a right side of the back portion is connected to a left side of the right-front portion; the left-front portion is provided at a left side thereof with multiple rows of loops, and the right-front portion is provided at a right side thereof with hooks, the hooks and the multiple rows of loops being connected to each other by hooking; a lower end of the left accessory breast receiving portion is connected to an upper end of the left-front portion and an upper end of the back portion sequentially, and a lower end of the right accessory breast receiving portion is connected to an upper end of the right-front portion and an upper end of the back portion sequentially; and the left accessory breast receiving portion, the right accessory breast receiving portion, and the back portion form a U-shaped back neckline, and the left accessory breast receiving portion, the right accessory breast receiving portion, the left-front portion, and the right-front portion form a U-shaped front neckline.

2. The corset according to claim 1, wherein the corset comprises an edge covering, which is connected by seaming to outer edges of the left-front portion, the left accessory breast receiving portion, the back portion, the right accessory breast receiving portion, and the right-front portion.

3. The corset according to claim 1, wherein the corset further comprises multiple supporting steel ribs, which are disposed along a longitudinal direction of the corset.

4. The corset according to claim 1, wherein an upper end of the left accessory breast receiving portion and an upper end of the right accessory breast receiving portion each have a curved shape.

5. The corset according to claim 1, wherein the corset is provided therein with a plurality of air-permeable through holes for air permeation.

6. The corset according to claim 1, wherein the left-front portion, the back portion, the right-front portion, the left accessory breast receiving portion, and the right accessory breast receiving portion are formed integrally.

* * * * *